US009273265B2

(12) United States Patent
Waynick

(10) Patent No.: US 9,273,265 B2
(45) Date of Patent: Mar. 1, 2016

(54) CALCIUM CARBONATE BASED SULFONATE GREASE COMPOSITIONS AND METHOD OF MANUFACTURE

(71) Applicant: J. Andrew Waynick, Lantana, TX (US)

(72) Inventor: J. Andrew Waynick, Lantana, TX (US)

(73) Assignee: NCH Corporation, Irving, TX (US)

( * ) Notice: Subject to any disclaimer, the term of this patent is extended or adjusted under 35 U.S.C. 154(b) by 193 days.

(21) Appl. No.: 13/664,574

(22) Filed: Oct. 31, 2012

(65) Prior Publication Data

US 2013/0109602 A1 May 2, 2013

Related U.S. Application Data

(60) Provisional application No. 61/553,674, filed on Oct. 31, 2011.

(51) Int. Cl.

| | |
|---|---|
| ***C10M 141/10*** | (2006.01) |
| ***C10M 169/04*** | (2006.01) |
| ***C10M 173/02*** | (2006.01) |
| ***C07F 5/04*** | (2006.01) |
| ***C10M 163/00*** | (2006.01) |
| ***C10M 159/24*** | (2006.01) |
| ***C10M 115/10*** | (2006.01) |
| ***C10M 177/00*** | (2006.01) |

(52) U.S. Cl.

CPC ..... *C10M 115/10* (2013.01); *C10M 177/00* (2013.01); *C10M 2201/02* (2013.01); *C10M 2201/062* (2013.01); *C10M 2201/08* (2013.01); *C10M 2201/084* (2013.01); *C10M 2201/085* (2013.01); *C10M 2201/087* (2013.01); *C10M 2203/1006* (2013.01); *C10M 2203/1065* (2013.01); *C10M 2205/024* (2013.01); *C10M 2205/028* (2013.01); *C10M 2207/02* (2013.01); *C10M 2207/022* (2013.01); *C10M 2207/046* (2013.01); *C10M 2207/10* (2013.01); *C10M 2207/121* (2013.01); *C10M 2207/122* (2013.01); *C10M 2207/125* (2013.01); *C10M 2207/128* (2013.01); *C10M 2207/289* (2013.01); *C10M 2209/103* (2013.01); *C10M 2215/064* (2013.01); *C10M 2215/082* (2013.01); *C10M 2215/20* (2013.01); *C10M 2215/226* (2013.01); *C10M 2219/044* (2013.01); *C10M 2219/046* (2013.01); *C10M 2219/0466* (2013.01); *C10M 2223/043* (2013.01); *C10N 2220/022* (2013.01); *C10N 2220/032* (2013.01); *C10N 2220/082* (2013.01); *C10N 2230/06* (2013.01); *C10N 2230/12* (2013.01); *C10N 2230/38* (2013.01); *C10N 2230/52* (2013.01); *C10N 2240/04* (2013.01); *C10N 2240/50* (2013.01); *C10N 2250/10* (2013.01); *C10N 2270/00* (2013.01)

(58) Field of Classification Search

CPC ..... C10M 113/04; C10M 113/08; C10M 113/10; C10M 115/10

USPC ..... 508/161, 162, 336, 391, 180, 200

See application file for complete search history.

(56) References Cited

U.S. PATENT DOCUMENTS

| | | | |
|---|---|---|---|
| 2,270,577 | A | 1/1942 | Bergstrom |
| 2,402,325 | A | 6/1946 | Griesinger |
| 2,418,894 | A | 4/1947 | McNab |
| 2,444,970 | A | 7/1948 | Zimmer |
| 2,485,861 | A | 10/1949 | Campbell |
| 2,501,731 | A | 3/1950 | Mertes |
| 2,535,101 | A | 12/1950 | Sproule |
| 2,540,533 | A | 2/1951 | Kolfenbach |
| 2,585,520 | A | 2/1952 | Van Ess |
| 2,616,904 | A | 11/1952 | Asseff |
| 2,616,905 | A | 11/1952 | Asseff |
| 2,616,906 | A | 11/1952 | Asseff |
| 2,616,911 | A | 11/1952 | Asseff |
| 2,616,924 | A | 11/1952 | Asseff |
| 2,616,925 | A | 11/1952 | Asseff |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2), p. 110-114.

(Continued)

*Primary Examiner* — Prem C Singh
*Assistant Examiner* — Francis C Campanell
(74) *Attorney, Agent, or Firm* — Ross Barnes LLP; Monty L. Ross; Robin L. Barnes

(57) ABSTRACT

An overbased calcium sulfonate grease composition comprising a reduced amount of overbased calcium sulfonate, added calcium carbonate, base oil, one or more converting agents, and one or more complexing acids if a complex grease is desired. The calcium sulfonate grease composition improves thickener yield and expected high temperature utility as demonstrated by dropping point. The calcium carbonate may be used to react with complexing acids when making a complex grease, such that the addition of calcium oxide or calcium hydroxide is not required. A method of making the composition comprising the steps of mixing the overbased calcium sulfonate and base oil, adding the calcium carbonate, adding one or more converting agents, and adding one or more complexing acids. All or a portion of one or more of the complexing acids may be added with or prior to the one or more converting agents.

28 Claims, No Drawings

(56) References Cited

U.S. PATENT DOCUMENTS

| | | | |
|---|---|---|---|
| 2,617,049 | A | 11/1952 | Asseff |
| 2,695,910 | A | 11/1954 | Asseff |
| 2,723,235 | A | 11/1955 | Asseff |
| 2,839,470 | A | 6/1958 | Warren |
| 2,861,951 | A | 11/1958 | Carlyle |
| 2,865,956 | A | 12/1958 | Ellis |
| 2,920,105 | A | 1/1960 | Kluge |
| 2,937,991 | A | 5/1960 | Carlyle |
| 2,956,018 | A | 10/1960 | Carlyle |
| 2,967,151 | A | 1/1961 | Morway |
| 2,977,301 | A | 3/1961 | Bergen |
| 2,978,410 | A | 4/1961 | Fullerton |
| 3,027,325 | A | 3/1962 | McMillen |
| 3,057,896 | A | 10/1962 | Schlicht et al. |
| 3,150,088 | A | 9/1964 | Hunt et al. |
| 3,186,944 | A | 6/1965 | Dreher |
| 3,242,079 | A | 3/1966 | McMillen |
| 3,372,115 | A | 3/1968 | McMillen |
| 3,376,222 | A | 4/1968 | McMillen |
| 3,377,283 | A | 4/1968 | McMillen |
| 3,492,231 | A | 1/1970 | McMillen |
| 3,537,996 | A | 11/1970 | Holst |
| 3,655,558 | A | 4/1972 | Geyer et al. |
| 3,661,622 | A | 5/1972 | Rogers |
| 3,671,012 | A | 6/1972 | Scott |
| 3,679,584 | A | 7/1972 | Hellmuth |
| 3,746,643 | A | 7/1973 | Rogers |
| 3,816,310 | A | 6/1974 | Hunt |
| 3,850,823 | A | 11/1974 | Kjonaas |
| 3,907,691 | A | 9/1975 | King et al. |
| 3,929,650 | A | 12/1975 | King et al. |
| 3,940,339 | A | 2/1976 | Clarke, Jr. et al. |
| 4,376,060 | A | 3/1983 | Stadler |
| 4,483,775 | A | 11/1984 | Yamaguchi |
| 4,560,489 | A | 12/1985 | Muir |
| 4,597,880 | A | 7/1986 | Eliades |
| 4,728,578 | A | 3/1988 | Higgins et al. |
| 4,744,920 | A | 5/1988 | Fischer et al. |
| 4,780,224 | A | 10/1988 | Jao |
| 4,810,396 | A | 3/1989 | Jao et al. |
| 4,810,398 | A | 3/1989 | Van Kruchten et al. |
| 4,824,584 | A | 4/1989 | Muir |
| 4,929,371 | A | 5/1990 | Waynick |
| 5,084,193 | A | 1/1992 | Waynick |
| 5,126,062 | A | 6/1992 | Barnes |
| 5,190,678 | A | 3/1993 | Swartz |
| 5,308,514 | A | 5/1994 | Olson |
| 5,338,467 | A * | 8/1994 | Olson et al. ..... 508/186 |
| 6,239,083 | B1 | 5/2001 | Muir |
| 6,869,111 | B2 | 3/2005 | Goto et al. |
| 6,875,731 | B1 | 4/2005 | Bence |
| 7,241,723 | B2 | 7/2007 | Zhang |
| 7,294,608 | B2 | 11/2007 | Oldiges |
| 7,517,837 | B2 | 4/2009 | Kurosky et al. |
| 2005/0215442 | A1 | 9/2005 | Sivik et al. |
| 2006/0223719 | A1 | 10/2006 | Riff et al. |
| 2007/0060485 | A1 | 3/2007 | Waynick |
| 2011/0021391 | A1 | 1/2011 | E et al. |
| 2011/0092404 | A1 | 4/2011 | Zhang et al. |
| 2011/0136709 | A1 | 6/2011 | Tanaka et al. |
| 2011/0160105 | A1 | 6/2011 | Tanaka et al. |
| 2011/0190177 | A1 | 8/2011 | Zaki |
| 2011/0195880 | A1 | 8/2011 | Kawamura et al. |
| 2011/0233473 | A1 | 9/2011 | Fletcher |

FOREIGN PATENT DOCUMENTS

| | | |
|---|---|---|
| CN | 102634400 | 8/2012 |
| GB | 816318 | 7/1959 |
| GB | 1239860 | 7/1971 |
| JP | 2004346120 | 12/2004 |

OTHER PUBLICATIONS

Boner, C.J. Manufacture and Application of Lubricating Greases, 1954, p. 357,369, Hafner Publishing Company, Inc.

* cited by examiner

CALCIUM CARBONATE BASED SULFONATE GREASE COMPOSITIONS AND METHOD OF MANUFACTURE

CROSS-REFERENCE TO RELATED APPLICATION

This application claims the benefit of U.S. provisional patent application No. 61/553,674 filed Oct. 31, 2011.

BACKGROUND OF THE INVENTION

1. Field of the Invention

This invention relates to overbased calcium sulfonate greases made with added calcium carbonate as the base source and the method for manufacturing such greases to provide improvements in both thickener yield and expected high temperature utility as demonstrated by dropping point.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases. Typically the second step ("conversion") is to add a converting agent or agents, such as propylene glycol, isopropyl alcohol, water, formic acid or acetic acid, to the product of the promotion step, along with a suitable base oil (such as mineral oil), to convert the amorphous calcium carbonate to a very finely divided dispersion of crystalline calcium carbonate. Because an excess of calcium hydroxide or calcium oxide is used to achieve overbasing, a small amount of residual calcium oxide or calcium hydroxide may also be present and will be dispersed. The crystalline form of the calcium carbonate is preferably calcite. This extremely finely divided calcium carbonate, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

In addition to simple calcium sulfonate greases, calcium sulfonate complex grease compounds are also known in the prior art. These complex greases are typically produced by adding a strong calcium-containing base, such as calcium hydroxide or calcium oxide, to the simple calcium sulfonate grease produced by either the two-step or one-step process and reacting with stoichiometrically equivalent amounts of complexing acids, such as 12-hydroxystearic acid, boric acid, acetic acid, or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467.

All of the known prior art teaches the use of calcium oxide or calcium hydroxide as the sources of basic calcium for production of calcium sulfonate greases or as a required component for reacting with complexing acids to form calcium sulfonate complex greases. The known prior art generally teaches that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate is generally considered to be a weak base, unsuitable for reacting with complexing acids. The second being that the presence of unreacted solid calcium compounds (including calcium carbonate, calcium hydroxide or calcium oxide) interferes with the conversion process, resulting in inferior grease compounds if the unreacted solids are not removed prior to conversion or before conversion is completed.

Additionally, the prior art does not provide a calcium sulfonate complex grease with both improved thickener yield and dropping point. The known prior art requires an amount of overbased calcium sulfonate of least 36% (by weight of the final grease product) to achieve a suitable grease in the NGLI No. 2 category with a demonstrated dropping point of at least 575 F. The overbased oil-soluble calcium sulfonate is one of the most expensive ingredients in making calcium sulfonate grease, therefore it is desirable to reduce the amount of this ingredient while still maintaining a desirable level of firmness in the final grease (thereby improving thickener yield). Specifically, it is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295). Higher dropping points are considered desirable since the dropping point is the first and most easily determined guide as to the high temperature utility limitations of a lubricating grease

SUMMARY OF THE INVENTION

This invention relates to overbased calcium sulfonate greases made with the addition of solid calcium carbonate and the method for manufacturing such greases to provide improvements in both thickener yield (requiring less overbased calcium sulfonate while maintaining acceptable penetration measurements) and expected high temperature utility as demonstrated by dropping point. Although the known prior art consistently and uniformly teaches against making a high quality calcium sulfonate-based grease by having basic materials, such as the weak base calcium carbonate, present as an insoluble solid before conversion, it has been found that a suitable simple calcium sulfonate grease may be produced according to the invention by adding calcium carbonate before conversion. The known prior art also teaches against using the weak base calcium carbonate as the base material to react with complexing acids when producing calcium sulfonate complex greases; however, it has been also found that an improved calcium sulfonate complex grease may be produced according to the invention by using calcium carbonate as the added base, and as the sole added base, to react with complexing acids. Additionally, the known prior art generally requires an amount of overbased oil-soluble calcium sulfonate of 36% or greater (by weight of the final grease product) to achieve a firm enough grease while also having a dropping point of 575 F or higher. The overbased oil-soluble calcium sulfonate is one of the most expensive ingredients in making a calcium sulfonate grease, so it is desirable to reduce the amount of this ingredient while still providing excellent demonstrated dropping point properties. Such a reduction has been achieved with the greases according to the invention without resulting in a grease that is too soft or a dropping point that is inferior.

According to one preferred embodiment of the invention, a highly overbased oil-soluble calcium sulfonate grease composition is provided having the following ingredients by weight percent of the final grease product (although, some ingredients, such as water, may not be in the final grease product or may not be in the concentrations indicated for addition): 20%-36% overbased calcium sulfonate, 4%-15% added calcium carbonate, 2%-5% water, 1%-4% other converting agents, such as alcohols, ethers, glycols, glycol ethers, glycol polyethers, and carboxylic acids, an optional 1%-4% alkyl benzene sulfonic acid; and optionally 2.8%-11.0% (total) of one or more complexing acids, such as boric acid, acetic acid, 12 hydroxystearic acid, or phosphoric acid (when a complex grease is desired). The calcium sulfonate complex grease according to this preferred embodiment is an NGLI No. 2 grade grease having a dropping point of 575 F or higher.

According to one embodiment of the invention, a simple calcium sulfonate grease is produced by combining a highly overbased oil-soluble calcium sulfonate comprising amorphous calcium carbonate as the primary overbasing material with an appropriate initial amount of a suitable base oil, such as mineral oil, which is then admixed with finely divided calcium carbonate as the sole added calcium-containing base and a converting agent or agents, then heated as needed to a temperature range of about 190 F to 200 F for a period of time necessary for effective conversion of the amorphous calcium carbonate to an extremely finely divided dispersion of crystalline calcium carbonate in the presence of the previously added calcium carbonate base, then rapidly heated to 380 F to 400 F to remove water and volatile reaction byproducts, then cooled, with additional base oil added as required. The final simple grease product is then milled as appropriate according to methods known in the art to achieve a smooth, homogenous, high quality simple calcium sulfonate grease.

According to another embodiment of the invention, an improved calcium sulfonate complex grease is produced by adding one or more complexing acids to a simple calcium sulfonate grease, such as the one described above, without the necessity of adding any calcium oxide or calcium hydroxide. A portion of one of more of these complexing acids may be added prior to conversion of the simple calcium sulfonate grease, with the remainder of the one or more complexing acids added after conversion. Even though calcium carbonate is considered a weak base, the stoichiometric excess of such added in making the simple grease is more than sufficient to react with the complexing acid or acids to make the complex grease. According to this embodiment of the invention, there is no need to add any calcium oxide or calcium hydroxide to complete the reaction, thus saving time and the expense associated with the additional processing step and additional ingredients in the prior art methods of producing calcium sulfonate complex greases. Furthermore, as will be subsequently shown, the greases of this invention that use calcium carbonate as the sole base for reaction with complexing acids are superior to prior art greases that use calcium hydroxide or calcium oxide for reaction with complexing acids.

When produced in accordance with the parameters of the invention described herein, consistently high quality calcium sulfonate greases may be made with thickener yield and dropping point properties superior to those of prior art greases. The overbased calcium sulfonate complex greases made according to the invention have an NLGI No. 2 grade consistency (or better) and a dropping point of 575° F. (or higher), with the percentage of overbased oil-soluble calcium sulfonate being below 36%. The lower concentrations of the overbased oil-soluble calcium sulfonate achieved by the invention are desirable since the cost of the grease is reduced. Other properties such as mobility and pumpability, especially at lower temperatures, may also be favorably impacted by the improved thickener yield achieved according to the invention.

DESCRIPTION OF THE PREFERRED EMBODIMENTS

According to one embodiment of the invention, this overbased simple grease is produced by reacting and mixing certain compounds comprising: (a) a primary overbasing material comprising overbased oil-soluble calcium sulfonate having amorphous calcium carbonate dispersed therein; (b) a suitable base oil of an amount appropriate to provide a final acceptable product consistency; (c) a stoichiometric excess of finely divided calcium carbonate as an oil-insoluble solid calcium-containing base added to the primary overbasing material and base oil before conversion; and (d) a converting agent or agents, some or all of which may not be in the final finished product due to volatilization during manufacture. Optionally, a facilitating acid may be added prior to conversion according to another embodiment of the invention. Such facilitating acid aids in grease structure formation. According to these embodiments, no calcium hydroxide or calcium oxide is required to be added in making the grease.

The highly overbased oil-soluble calcium sulfonate used according to this embodiment of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WOas supplied by Lubrizol Corporation. The amount of the highly overbased oil-soluble calcium sulfonate in the final grease according to this embodiment of the invention can vary, but is generally between 10 and 45%. Preferably, the amount of the highly overbased oil-soluble calcium sulfonate in the final grease according to an embodiment of the invention is between 20 and 36% and most preferably between 25 and 32%.

Any petroleum-based naphthenic or paraffinic mineral oils commonly used and well known in the grease making art may be used as the base oil according to the invention. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) will typically be between 30% and 60%, preferably 35% and 55%, most preferably 40% and 50%, based on the final weight of the grease.

The calcium carbonate used according to this embodiment of the invention is finely divided with a mean particle size of less than 20 microns, preferably less than 10 microns, most preferably less than or equal to 5 microns. Furthermore, the calcium carbonate preferably is of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of calcium carbonate added is between 2.0% and 20%, preferably 4% and 15%, most preferably 6% and 10%, based on the final weight of the grease. According to this embodiment of the invention, the calcium carbonate is added prior to conversion as the sole added calcium-containing base ingredient. Although calcium oxide or calcium hydroxide may have been used to produce the overbased calcium sulfonate, it is not necessary to add any calcium oxide or calcium hydroxide prior to or after conversion.

One or more converting agents, such as alcohols, ethers, glycols, glycol ethers, glycol polyethers, carboxylic acids, inorganic acids, organic nitrates, and any other compounds that contain either active or tautomeric hydrogen, are used according to this embodiment. The amount of such converting agents added, based on the final weight of the grease, is between 0.1% and 5%, preferably 1.0% and 4%, most preferably 1.5% and 3.0%. Depending on the converting agents used, they may be removed by volatilization during the manufacturing process. Especially preferred are the lower molecular weight glycols such as hexylene glycol and propylene glycol. Water is typically also added in an amount between 1.5% and 10%, preferably between 2.0% and 5.0%, most preferably between 2.2% and 4.5%, based on the weight of the final grease. It should be noted that some converting agents may also serve as complexing acids, to produce a calcium sulfonate complex grease according to another embodiment of the invention described below. Such materials will simultaneously provide both functions of converting and complexing.

Although not required, a small amount of a facilitating acid may be added to the mixture prior to conversion according to another embodiment of the invention. Suitable facilitating acids, such as an alkyl benzene sulfonic acid, having an alkyl chain length typically between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion in an amount between 0.50% to 5.0%, preferably 1.0% to 4.0%, most preferably 2.0% to 3.6%, based on the final weight of the grease. If the calcium sulfonate is made in situ using alkyl benzene sulfonic acid, the facilitating acid added according to this embodiment is in addition to that required to produce the calcium sulfonate.

According to another embodiment of the invention, a high quality overbased calcium sulfonate complex grease is produced. Such complex grease is made by reacting the simple grease produced according to other embodiments of this invention with one or more complexing acids. A portion of one or more of these complexing acids may optionally be added before conversion with the remainder added after conversion. According to these embodiments, no calcium hydroxide or calcium oxide is required to be added in making the complex grease.

Complexing acids used in this embodiment will comprise at least one and preferably two or more of the following: long chain carboxylic acids, short chain carboxylic acids, boric acid, and phosphoric acid. The total amount of complexing acids added is preferably between 2.8% and 11% by weight of the final grease. The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid. The amount of long chain carboxylic acid is between 0.5% and 5.0%, preferably 1.0% to 4.0%, most preferably 2.0% to 3.0%, based on the final weight of the grease.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. The amount of short chain carboxylic acids is between 0.05% and 2.0%, preferably 0.1% to 1.0%, most preferably 0.2% to 0.5%, based on the final weight of the grease. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture.

If boric acid is used as a complexing acid according to this embodiment, an amount between 0.4% to about 4.0%, preferably 0.7% to 3.0%, and most preferably 1.0% and 2.5%, based on the final weight of the grease, is added. The boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, berated carboxylic acids, borated sulfonic acids, borated epoxides, berated peroxides and the like may be used instead of boric acid. If phosphoric acid is used as a complexing acid, an amount between 0.4% to 4.0%, preferably 1.0% and 3.0%, most preferably 1.4% and 2.0%, based on the final weight of the grease, is added. The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

The complexing acid or acids react with the calcium carbonate. Prior art greases and methods of making greases require the post-conversion addition of calcium oxide or calcium hydroxide as a strong base to react with the complexing acid. In accordance with the invention, no calcium oxide or calcium hydroxide is required to be added to the mixture. The calcium carbonate, present in a stoichiometric excess amount, is sufficient to react with the complexing acids and is the sole added basic ingredient needed to produce a high quality complex grease according to the invention. Although small amounts of calcium oxide or calcium hydroxide may be dispersed in the overbased calcium sulfonate, and may also react with the complexing acids, there is no need to add such components for sufficient reaction of those acids. In general, as will be evident in the subsequent examples, there will be much less of any such small amounts of calcium oxide or calcium hydroxide to react with the bulk of the added complexing acids. The added calcium carbonate serves as the sole source of added basic material to react with the complexing acids.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention. Additional calcium carbonate may be added to either the simple or complex grease embodiments of the invention after conversion, and after all reaction with complexing acids is complete in the case of a complex grease. However, references to added calcium carbonate herein refer to the calcium carbonate that is added prior to conversion and as the sole added calcium-containing base for reaction with complexing acids when making a complex grease according to the invention.

The compositions according to the invention are preferably made according to the method described herein. This method comprises the steps of: (1) admixing in a suitable grease manufacturing vessel a highly overbased oil-soluble calcium sulfonate and an appropriate amount of a suitable base oil at a temperature of between ambient air temperature and about 190 F; (2) admixing finely divided calcium carbonate; (3) optionally admixing a facilitating acid; (4) admixing a converting agent or agents; (5) and continuing to mix while heating as required to about 190 F-200 F and remaining at that temperature range until conversion of the amorphous calcium carbonate to very finely divided crystalline calcium carbonate is complete. This process results in a preferred simple calcium sulfonate grease. To produce a calcium sulfonate complex grease composition according to the invention, the method preferably comprises previous steps (1)-(5) and the additional steps of: (6) adding any complexing acids required with all or part of them added before conversion and the remainder added after conversion; (7) mixing and heating to a temperature sufficiently high to insure removal of water and any volatile reaction byproducts and optimize final product quality; (8) cooling the grease while adding additional base oil as needed; (9) adding remaining desired additives as are well known in the art; and, if desired, (10) milling the final grease as required to obtain a final smooth homogenous product.

This process may occur in either an open or closed kettle as is commonly used for grease manufacturing. The conversion process can be achieved at normal atmospheric pressure or under pressure in a closed kettle. Manufacturing in open kettles is preferred since such grease manufacturing equipment is commonly available.

Certain aspects of the process are not critical to obtaining a preferred calcium sulfonate grease composition according to the invention. For instance, the order that the calcium carbonate, water, and other converting agents are added relative to each other is not important. Also, the temperature at which the calcium carbonate, water, and other converting agents are added is not critical, but it is preferred that they be added before the temperature reaches 190 F to 200 F. However, for the sake of convenience, these components are usually added at the beginning of the process, as will be illustrated in the examples provided below. When more than one complexing acid is used, the order in which they are added either before or after conversion is not generally important.

According to one preferred method of making a calcium sulfonate grease according to the invention, water is removed from the grease after conversion. Preferably, the grease is heated after conversion is complete and all complexing acids (if a complex grease is being made) have been added to remove the water as quickly as possible. This is generally possible by heating and mixing the batch under open conditions. Having water in the grease batch for prolonged periods of time may result in degradation of thickener yield, dropping point, or both, and such adverse effects may be avoided by removing the water quickly.

The converted grease should be heated to a temperature sufficiently high to remove the water that was initially added as a converting agent, as well as any water formed by chemical reactions during the formation of the grease. Generally, this temperature will be between 250 F and 300 F, preferably 300 F to 380 F, most preferably 380 F to 400 F. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed.

The overbased calcium sulfonate grease compositions and methods for making such compositions according to the invention are further described and explained in relation to the following examples:

EXAMPLE 1

A calcium sulfonate complex grease was prepared according to the present invention as follows: 36.00 parts by weight of a 400 TBN overbased calcium sulfonate (having amorphous calcium carbonate dispersed therein) was added to an open mixing vessel followed by 33.38 parts of a solvent neutral group 1 paraffinic base oil having a viscosity of about 600 SUS at 100 F, and 1.00 part of PAO having a viscosity of 4 cSt at 100 C. Mixing without heat began using a planetary mixing paddle. Then 3.60 parts of a primarily C12 alkylbenzene sulfonic acid was added as a facilitating acid. After 20 minutes, 7.58 parts of finely divided calcium carbonate with a mean particle size below 5 microns was added as a source of basic calcium and allowed to mix in for 10 minutes. Then 1.80 parts of hexylene glycol and 4.5 parts water were added as converting agents. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 2.84 parts of 12-hydroxystearic acid was added followed by 0.28 parts glacial acetic acid. Then 1.90 parts of a 75% solution of phosphoric acid in water was added. These three acids were the complexing acids for this batch. The mixture was then heated with an electric heating mantle. When the grease reached 300 F, 2.78 parts of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, another 8.34 parts of the same paraffinic group 1 base oil was added. When the temperature of the grease cooled to 200 F, 0.50 parts of a polyisobutylene polymer was added. Mixing continued until the grease reached a temperature of 170 F. The grease was then removed from the mixer and given three passes through a three-roll mill to achieve the final smooth homogenous texture. The grease had an unworked penetration of 252 and a worked 60 strokes penetration of 253. The dropping point was 608 F. The percentage of overbased oil-soluble calcium sulfonate in the grease of this batch was 36.0%. Note that the only calcium-containing base added to make this grease was calcium carbonate. No calcium hydroxide or calcium oxide was added during the making of this grease

EXAMPLE 2

Another batch of grease was made using the same equipment, raw materials, amounts, and manufacturing process as the Example 1 grease, except that the calcium carbonate was added immediately after conversion but before the complexing acids (12-hydroxystearic acid, acetic acid, and phosphoric acid) were added. The ingredient composition of this grease was identical to the previous Example 1 grease. The final grease had an unworked penetration of 285 and a worked 60 stroke penetration of 288. The dropping point was 555 F. The percentage of overbased oil-soluble calcium sulfonate in the grease of this batch was 36.0%. As can be seen, the grease of this example was both softer than the Example 1 grease by 35 points and had a dropping point that was significantly lower. Since the only difference between these two greases was the timing of adding the calcium carbonate relative to conversion, the softer consistency (lower thickener yield) and lower dropping point must be due to that difference. Thus, adding calcium carbonate before conversion according to a preferred embodiment of the invention provides a superior product to the same composition if the calcium carbonate is added after conversion.

A comparison of the greases of Examples 1 and 2 demonstrate yet another important point. When the complexing acids are added in Example 1, the grease at that point is a simple calcium sulfonate grease that was formed with added calcium carbonate (in addition to the amorphous calcium carbonate dispersed in the overbased calcium sulfonate that is converted to a crystalline dispersion during the conversion process) present during conversion. When the complexing acids are added in Example 2, the grease at that point is a simple calcium sulfonate grease that was formed without added calcium carbonate present during conversion, but to which the calcium carbonate was added after conversion. At the point that the complexing acids are added, the simple calcium sulfonate greases in Examples 1 and 2 are identical in composition. The same complexing acids in the same amounts were used in both Examples. The only difference is whether or not the simple calcium sulfonate grease was formed with added calcium carbonate present during conversion or added later, after grease formation. Therefore, any difference in the properties of the final calcium sulfonate complex grease must correspond to the difference in the simple calcium sulfonate greases from which they were made. This demonstrates that forming a simple calcium sulfonate grease with added calcium carbonate present before conversion provides a superior simple grease composition to one where calcium carbonate is added after conversion. Additional examples 3-7 provide further confirmation of this fact as well as the advantageous properties of the present invention compared to prior art greases where strong bases such as calcium hydroxide are used.

EXAMPLE 3

Another batch of grease was made using the same equipment, raw materials, amounts, and manufacturing process as the Example 1 grease except for the following changes: (1) the acetic acid was added just before adding the hexylene glycol and water while the batch was at ambient temperature; (2) the 12-hydroxystearic acid was added before conversion at 170 F while heating the batch to 190 F; and (3) no calcium carbonate was added. The percentage of overbased oil-soluble calcium sulfonate in this batch was 36.0%. This batch did not convert to a grease structure even after several hours of heating and was abandoned.

EXAMPLE 4

Another batch of grease was made similar to the Example 1 grease except for the following change: the calcium carbonate was not added until after the conversion and after the complexing acids (12-hydroxystearic acid, acetic acid, and phosphoric acid) were added. The final grease had an unworked penetration of 308 and a worked 60 stroke penetration of 305. The dropping point was 567. The percentage of overbased oil-soluble calcium sulfonate in the grease of this batch was 36.0%.

Examples 3 and 4 continue to demonstrate the importance of adding the calcium carbonate as the sole added calcium-containing base before conversion as opposed to after conversion or not adding it at all. In the Example 3 grease, when no calcium carbonate was added and the acetic acid and 12-hydroxystearic acid were added before conversion as converting agents, conversion did not occur, and no grease structure was obtained. In the Example 4 grease, when the calcium carbonate was added after conversion and after the addition of the three complexing acids, the grease was softer than the Example 1 grease by 52 points, and the dropping point was also significantly lowered.

EXAMPLE 5

A calcium sulfonate complex grease was prepared according to a preferred embodiment of the present invention as follows: 36.00 parts by weight of a 400 TBN overbased calcium sulfonate (with amorphous calcium carbonate dispersed therein) was added to an open mixing vessel followed by 33.15 parts of a solvent neutral group 1 paraffinic base oil having a viscosity of about 600 SUS at 100 F, and 1.00 part of PAO having a viscosity of 4 cSt at 100 C. Mixing without heat began using a planetary mixing paddle. Then 3.60 parts of a primarily C12 alkylbenzene sulfonic acid was added as a facilitating acid. After 20 minutes, 7.58 parts of finely divided calcium carbonate with a mean particle size below 5 microns was added and allowed to mix in for 10 minutes. Then 1.80 parts of hexylene glycol and 2.2 parts water were added as converting agents. The mixture was heated until the temperature reached 190F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 2.84 parts of 12-hydroxystearic acid was added followed by 0.56 parts glacial acetic acid. Then 1.90 parts of a 75% solution of phosphoric acid in water was added. These three acids were the complexing acids for this batch. The mixture was then heated with an electric heating mantle while continuing to stir. When the grease reached 300 F, 2.78 parts of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, another 8.29 parts of the same paraffinic group 1 base oil was added. When the temperature of the grease cooled to 200 F, 0.50 parts of a polyisobutylene polymer was added. Mixing continued until the grease reached a temperature of 170 F. The grease was then removed from the mixer and given three passes through a three-roll mill to achieve the final smooth homogenous texture. The grease had an unworked penetration of 240 and a worked 60 strokes penetration of 239. The dropping point was 644 F. The percentage of overbased oil-soluble calcium sulfonate in the grease of this batch was 36.0%. Note that the only calcium-containing base added to make this grease was calcium carbonate. No calcium hydroxide or calcium oxide was added during the making of this grease.

It is seen that the greases of both Example 5 and Example 1 have dropping points much higher than the value reported for the calcium sulfonate complex grease of Example V of U.S. Pat. No. 4,560,489 wherein calcium hydroxide was used as the calcium-containing base added after conversion to react with the complexing acids Also, the unworked penetration of this prior art grease was reported to be 271 and the percent of the 400 TBN calcium sulfonate used was about 36.7%, based on the compositional information provided by the inventors. By comparison, the worked penetrations of Examples 1 and 5 of the present invention were significantly harder (smaller values) even though the percentage of the 400 TBN calcium sulfonate was 36%. Furthermore, in Example I of U.S. Pat. No. 4,560,489, the percent of the 400 TBN calcium sulfonate was about 41.7%, and the grease was reported to have a worked penetration within the NLGI No. 2 range, namely between 265 and 295. By comparison, the worked penetrations of Examples 1 and 5 of the present invention were significantly harder (smaller values) even though the percentage of the 400 TBN calcium sulfonate was 36%. Note that in both the Example 1 and 5 greases, more oil would have been needed to soften the consistency to an NLGI No. 2 grade. This would necessarily reduce the concentration of the original oil-soluble overbased calcium sulfonate below 36%. This demonstrates that the present invention provides both superior thickener yield and higher dropping point compared to the prior art technology of adding calcium hydroxide for reaction with the complexing acids. Additionally, the present invention requires less overbased oil-soluble calcium sulfonate compared to the prior art compositions, which reduces the costs involved.

An advantage of the preferred compositions of the present invention over the prior art is further demonstrated by comparison with the example provided in U.S. Pat. No. 5,126,062. In the Example 1 grease of that prior art patent, the percentage of the 400 TBN calcium sulfonate was 45%, based on compositional information provided by the inventor. The dropping point was not precisely disclosed, but was only said to be above 600 F. The worked 60 stroke penetration was reported as 280. In this prior art grease, calcium carbonate was added before conversion, but calcium hydroxide was also added in sufficient amount after conversion to fully react with all the complexing acids added thereafter. Furthermore, the complexing acids used in this prior art patent are the ones used in the Example 1 and Example 5 greases of the present invention. As can be seen, the Examples 1 and 5 greases of the present invention have dropping points that are at least as good as if not better than the prior art Example 1 grease of U.S. Pat. No. 5,126,062. Furthermore, the thickener yield of the Examples 1 and 5 greases of the present invention greases are far superior since their percentage of the 400 TBN calcium sulfonate is 36% and the worked penetrations are much harder. This comparison shows that even when adding calcium carbonate before conversion, it is better to use that calcium carbonate as the sole added base for reaction with complexing acids rather than adding calcium hydroxide after conversion.

EXAMPLE 6

Another batch of grease was made using the same equipment, raw materials, amounts, and manufacturing process as the Example 5 grease, except that the calcium carbonate was added immediately after conversion but before the 12-hydroxystearic acid, acetic acid, and phosphoric acid were added. The ingredient composition of this grease was identical to the composition of the previous Example 5 grease. The final grease had an unworked penetration of 236 and a worked 60 stroke penetration of 240. The dropping point was 416 F. The percentage of overbased oil-soluble calcium sulfonate in the grease of this batch was 36.0%. Once again, the clear advantage of adding the calcium carbonate pre-conversion instead of post-conversion is observed. Although the penetrations of the Example 5 and 6 greases were comparable, the dropping point of the Example 6 grease where the calcium carbonate was added after conversion was nearly 200 F lower than the Example 5 grease where the calcium carbonate was added pre-conversion.

EXAMPLE 7

To demonstrate that adding calcium carbonate pre-conversion as the sole added base is superior to adding calcium hydroxide pre-conversion and to adding calcium carbonate both post conversion and after all reaction with complexing acids, a grease was prepared as follows: 37.87 parts by weight of a 400 TBN overbased calcium sulfonate was added to an open mixing vessel followed by 30.13 parts of a solvent neutral group 1 paraffinic base oil having a viscosity of about 600 SUS at 100 F. Mixing without heat began using a planetary mixing paddle. Then 3.19 parts of a primarily C12 alkylbenzene sulfonic acid was added. After 20 minutes, 3.19 parts of finely divided food grade purity calcium hydroxide with a mean particle size of about 4 microns was added and allowed to mix in for 10 minutes. Then 2.13 parts of hexylene glycol and 4.5 parts water were added. The mixture was heated until the temperature reached 190 F. The temperature was held between 190 F and 200 F until Fourier Transform Infrared (FTIR) spectroscopy indicated that the conversion of the amorphous calcium carbonate to crystalline calcium carbonate (calcite) had occurred. Immediately, 3.19 parts of 12-hydroxystearic acid was added followed by 0.32 parts glacial acetic acid. Then 2.02 parts of a 75% solution of phosphoric acid in water was added. These three acids were the complexing acids for this batch. The mixture was then heated with an electric heating mantle while continuing to heat. When the grease reached 250 F and it appeared that all the water had volatilized, 7.45 parts of the same calcium carbonate used in the previous examples herein was added. When the grease reached 300 F, 2.13 parts of a styrene-isoprene copolymer was added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, another 7.53 parts of the same paraffinic group 1 base oil was added. When the temperature of the grease cooled to 200 F, 0.50 parts of a polyisobutylene polymer was added. Because the grease appeared heavy, another 20.83 parts of the same paraffinic group 1 base oil were added. Mixing continued until the grease reached a temperature of 170 F. The grease was then removed from the mixer and given three passes through a three-roll mill to achieve the final smooth homogenous texture. The grease had an unworked penetration of 278. The percentage of overbased oil-soluble calcium sulfonate in the grease of this batch was 31.3%, which is not significantly better than the percentage of overbased oil-soluble calcium sulfonate in Examples 1 and 5 once additional oil is added to achieve NGLI No. 2 grade greases, particularly when the dropping point for this Example 7 grease was only 523 F, which is much lower than the dropping points of Examples 1 and 5.

Summarizing thus far, these first seven examples taken together strongly demonstrate the following: (1) overbased calcium sulfonate-based greases can be prepared using calcium carbonate as the only added calcium-containing base for reaction with complexing acids; (2) use of calcium carbonate added pre-conversion provides superior greases compared to when the calcium carbonate is added post-conversion, even when this is the only difference between the two greases; (3) adding calcium carbonate before conversion as the sole added calcium-containing base provides superior greases compared to prior art greases where calcium carbonate was not added and calcium hydroxide was added after conversion; (4) adding calcium carbonate before conversion as the sole added calcium-containing base provides superior greases compared to prior art greases where calcium carbonate is added before conversion but calcium hydroxide is added after conversion for reaction with complexing acids; (5) adding calcium carbonate before conversion as the sole added calcium-containing base provides superior greases compared to greases where calcium hydroxide is added before conversion for reaction with complexing acids, and calcium carbonate is added after conversion and after reaction with the complexing acids.

The following six examples further demonstrates the superior properties of overbased calcium sulfonate greases of the present invention and also demonstrates the importance of the amount of water used during conversion and the time required to remove that water once conversion is complete.

EXAMPLES 8-13

Six batches of grease were made that were all identical to Example 1 except for the amount of water added before conversion and the amount of time the converted grease was heated at 190 F to 200 F before increasing the temperature so as to remove the water. TABLE 1, below provides the details of these differences.

TABLE 1

| | Example No. | | | | | |
|---|---|---|---|---|---|---|
| | 8 | 9 | 10 | 11 | 12 | 13 |
| % water | 2.2 | 1.1 | 9.0 | 9.0 | 4.5 | 2.2 |
| Time, minutes | 45 | 45 | 45 | 120 | 120 | 120 |
| Worked 60 stroke penetration | 244 | No grease formed | 270 | 268 | 264 | 250 |
| Dropping Point, F. | 609 | NA | 614 | 577 | 584 | 597 |

The percentage of overbased oil-soluble calcium sulfonate in all six of these greases was 36.0%. As can be seen from the data of these six examples, the best combination of thickener yield and dropping point is obtained by using between about 2.2% and 4.5% water and minimizing the time the water remains in the converted grease.

The following four examples show the effect of adding a portion of the complexing acids before conversion.

EXAMPLE 14

To demonstrate the effect of adding 20% of the 12-hydroxystearic acid before conversion as both converting agent and complexing acid, a grease was prepared as follows: 36.00 parts by weight of a 400 TBN overbased calcium sulfonate was added to an open mixing vessel followed by 33.38 parts of a solvent neutral group 1 paraffinic base oil having a viscosity of about 600 SUS at 100 F, and 1.00 part of PAO having a viscosity of 4 cSt at 100 C. Mixing without heat began using a planetary mixing paddle. Then 3.60 parts of a primarily C12 alkylbenzene sulfonic acid was added. After 20 minutes, 7.58 parts of finely divided calcium carbonate with a mean particle size below 5 microns was added and allowed to mix in for 10 minutes. Then, 0.57 parts of 12-hydroxystearic acid was added. After allowing about 10 minutes of mixing, 1.80 parts of hexylene glycol and 4.5 parts water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 2.27 parts of 12-hydroxystearic acid was added followed by 0.28 parts glacial acetic acid. Then 1.90 parts of a 75% solution of phosphoric acid in water was added. These three acids were the complexing acids for this batch. Note that of the total amount of 12-hydroxystearic acid added, 20% of it was added before conversion with the remaining 80% added after conversion. The mixture was then heated with an electric heating mantle while continuing to heat. When the grease reached 300 F, 2.78 parts of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, another 8.34 parts of the same paraffinic group 1 base oil was added. When the temperature of the grease cooled to 200 F, 0.50 parts of a polyisobutylene polymer was added. Mixing continued until the grease reached a temperature of 170 F. A portion of the grease was removed from the mixer and given three passes through a three-roll mil to achieve the final smooth homogenous texture. The grease had an unworked penetration of 207. The milled grease was returned to the mixer and another 15.0 parts of the same paraffinic base oil was added and allowed to mix in for 30 minutes. The grease was removed from the mixer and given three passes through a three-roll mil to achieve the final smooth homogenous texture. The grease had a worked 60 stroke penetration of 273 and a dropping point of 630 F. Note that the concentration of the overbased oil-soluble calcium sulfonate in this grease was 31.3%. This grease was also evaluated according to the Four Ball Extreme Pressure test ASTM D2596. The weld load was 800 kg.

EXAMPLE 15

To demonstrate the effect of adding 20% of the 12-hydroxystearic acid before conversion as both converting agent and complexing acid and with using boric acid as a complexing acid, a grease was prepared as follows: 36.00 parts by weight of a 400 TBN overbased calcium sulfonate was added to an open mixing vessel followed by 31.68 parts of a solvent neutral group 1 paraffinic base oil having a viscosity of about 600 SUS at 100 F, and 1.00 part of PAO having a viscosity of 4 cSt at 100 C. Mixing without heat began using a planetary mixing paddle. Then 3.60 parts of a primarily C12 alkylbenzene sulfonic acid was added. After 20 minutes, 7.58 parts of finely divided calcium carbonate with a mean particle size below 5 microns was added and allowed to mix in for 10 minutes. Then, 0.57 parts of 12-hydroxystearic acid was added. After allowing about 10 minutes of mixing, 1.80 parts of hexylene glycol and 4.5 parts water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 2.27 parts of 12-hydroxystearic acid was added followed by 2.40 parts boric acid that had been previously dissolved in 50 milliliters of hot water. Then 1.90 parts of a 75% solution of phosphoric acid in water was added. These three acids were the complexing acids for this batch. Note that of the total amount of 12-hydroxystearic acid added, 20% of it was added before conversion with the remaining 80% added after conversion. The mixture was then heated with an electric heating mantle while continuing to heat. When the grease reached 300 F, 2.78 parts of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, another 7.92 parts of the same paraffinic group 1 base oil was added. When the temperature of the grease cooled to 200 F, 0.50 parts of a polyisobutylene polymer was added. Mixing continued until the grease reached a temperature of 170 F. A portion of the grease was removed from the mixer and given three passes through a three-roll mil to achieve the final smooth homogenous texture. The grease had an unworked penetration of 209. The milled grease was returned to the mixer and another 18.9 parts of the same paraffinic base oil was added and allowed to mix in for 30 minutes. The grease was removed from the mixer and given three passes through a three-roll mil to achieve the final smooth homogenous texture. The grease had a worked 60 stroke penetration of 305 and a dropping point of 650 F. Note that the concentration of the overbased oil-soluble calcium sulfonate in this grease was 30.3%. This grease was also evaluated according to the Four Ball Extreme Pressure test ASTM D2596. The weld load was 800 kg.

EXAMPLE 16

Another batch was made similar to Example 15 except that 40% of the 12-hydroxystearic acid was added before conversion. It was made as follows: 36.00 parts by weight of a 400 TBN overbased calcium sulfonate was added to an open mixing vessel followed by 31.68 parts of a solvent neutral group 1 paraffinic base oil having a viscosity of about 600 SUS at 100 F, and 1.00 part of PAO having a viscosity of 4 cSt at 100 C. Mixing without heat began using a planetary mixing paddle. Then 3.60 parts of a primarily C12 alkylbenzene sulfonic acid was added. After 20 minutes, 7.58 parts of finely divided calcium carbonate with a mean particle size below 5 microns was added and allowed to mix in for 10 minutes. Then, 1.14 parts of 12-hydroxystearic acid was added. After allowing about 10 minutes of mixing, 1.80 parts of hexylene glycol and 4.5 parts water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 1.70 parts of 12-hydroxystearic acid was added followed by 2.40 parts boric acid that had been previously dissolved in 50 milliliters of hot water. Then 1.90 parts of a 75% solution of phosphoric acid in water was added. These three acids were the complexing acids for this batch. Note that of the total amount of 12-hydroxystearic acid added, 40% of it was added before conversion with the remaining 60% added after conversion. The mixture was then heated with an electric heating mantle while continuing to heat. When the grease reached 300 F, 2.78 parts of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, another 7.92 parts of the same paraffinic group 1 base oil was added. When the temperature of the grease cooled to 200 F, 0.50 parts of a polyisobutylene polymer was added. Mixing continued until the grease reached a temperature of 170 F. A portion of the grease was removed from the mixer and given three passes through a three-roll mil to achieve the final smooth homogenous texture. The grease had an unworked penetration of 229. The milled grease was returned to the mixer and another 10.0 parts of the same paraffinic base oil was added and allowed to mix in for 30 minutes. The grease was removed from the mixer and given three passes through a three-roll mil to achieve the final smooth homogenous texture. The grease had a worked 60 stroke penetration of 275 and a dropping point of greater than 650 F. Note that the concentration of the overbased oil-soluble calcium sulfonate in this grease was 32.7%. This grease was also evaluated according to the Four Ball Extreme Pressure test ASTM D2596. The weld load was 800 kg.

EXAMPLE 17

Another batch was made similar to Examples 15 and 16 except that 100% of the 12-hydroxystearic acid was added before conversion. It was made as follows: 36.00 parts by weight of a 400 TBN overbased calcium sulfonate was added to an open mixing vessel followed by 31.68 parts of a solvent neutral group 1 paraffinic base oil having a viscosity of about 600 SUS at 100 F, and 1.00 part of PAO having a viscosity of 4 cSt at 100 C. Mixing without heat began using a planetary mixing paddle. Then 3.60 parts of a primarily C12 alkylbenzene sulfonic acid was added. After 20 minutes, 7.58 parts of finely divided calcium carbonate with a mean particle size below 5 microns was added and allowed to mix in for 10 minutes. Then, 2.84 parts of 12-hydroxystearic acid was added. After allowing about 10 minutes of mixing, 1.80 parts of hexylene glycol and 4.5 parts water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During conversion, the grease that formed became so firm that another 7.92 parts of the same paraffinic group 1 base oil was added. Immediately after conversion was complete, 2.40 parts boric acid that had been previously dissolved in 50 milliliters of hot water was added. Then 1.90 parts of a 75% solution of phosphoric acid in water was added. These three acids were the complexing acids for this batch. Note that all of 12-hydroxystearic acid added was added before conversion. After the phosphoric acid had been added, another 6.02 parts of the same paraffinic base oil was added. The mixture was then heated with an electric heating mantle while continuing to heat. When the grease reached 300 F, 2.78 parts of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the temperature of the grease cooled to 200 F, 0.50 parts of a polyisobutylene polymer was added. Mixing continued until the grease reached a temperature of 170 F. A portion of the grease was removed from the mixer and given three passes through a three-roll mil to achieve the final smooth homogenous texture. The grease had an unworked penetration of 245. The milled grease was returned to the mixer and another 6.49 parts of the same paraffinic base oil was added and allowed to mix in for 30 minutes. The grease was removed from the mixer and given three passes through a three-roll mil to achieve the final smooth homogenous texture. The grease had a worked 60 stroke penetration of 269 and a dropping point of greater than 650 F. Note that the concentration of the overbased oil-soluble calcium sulfonate in this grease was 32.0%. This grease was also evaluated according to the Four Ball Extreme Pressure test ASTM D2596. The weld load was 800 kg.

EXAMPLE 18

This Example demonstrates how the present invention can be applied to prepare thickened compositions useful as open gear lubricants or braided wire rope lubricants. It was made as follows: 761.6 grams of a naphthenic base oil having a viscosity of about 2,000 SUS at 100 F was charged to an open mixer. To it was added 816 grams of a 400 TBN overbased calcium sulfonate. Mixing began using a planetary mixing paddle. Then 81.6 grams of a primarily C12 alkylbenzene sulfonic acid was added and allowed to mix for 15 minutes. At this point, 163.2 grams of a food grade calcium carbonate was added and allowed to mix in for 15 minutes. A 40.80 gram portion of hexylene glycol and 101.3 grams of water were added, and the mixture was heated using an electric heating mantle. Once the temperature reached 190 F it was held between 190 F and 200 F for 45 minutes until conversion of the amorphous calcium carbonate from the overbased oil-soluble calcium sulfonate was complete. The converted simple calcium sulfonate grease formed in the presence of added calcium carbonate as the only added calcium-containing base was heated to 300 F to remove the water. The heating mantle was removed, and as the batch began to cool, 163.20 grams of food grade anhydrous calcium sulfate was added. This was immediately followed by 1632 grams of a polybutene polymer and 1679.33 grams of the same naphthenic base oil that was previously added. Then 57.61 grams of an organic amine phosphate antiwearlcorrosion inhibitor, 28.8 grams morpholine, 5.76 grams of an organo-molybdenum complex Molyvan 855 available from R.T. Vanderbilt Company, 5.76 grams of an alkylated diphenylamine antioxidant, and 1.63 grams of a powdered oil-soluble blue dye was added. This was followed by an addition of another 177.69 grams of the naphthenic base oil and 158.46 grams of the polybutene polymer. The simple calcium sulfonate grease was stirred for 30 minutes. Then it was removed and given three passes through a three-roll mill. The resulting grease was very smooth and semi-fluid. It had an unworked penetration of 385. This batch was put back in the mixer, heated to 150 F with mixing, and 8.64 grams of a high molecular weight polyisobutylene polymer solution was added and allowed to mix in for 45 minutes. The batch was then removed again without any further milling and allowed to cool to 77 F. The unworked penetration was 403. This simple calcium sulfonate grease had an overbased oil-soluble calcium sulfonate concentration of 14.1%.

Several lab batches were made according to the above procedure and tested. The average results of those tests are as follows:

TABLE 2

| | |
|---|---|
| Unworked Penetration | 403 |
| Four Ball EP | |
| Last Non-Seizure Load, Kg | 126 |
| Weld Load, Kg | 620 |
| Load Wear Index | 74.8 |
| Four Ball Wear Scar, mm | 0.41 |
| Copper Strip Corrosion, 24 hrs, 100 C. | 1 A |
| Copper Strip Corrosion, 24 hrs, 150 C. | 1 A |
| Density, grams/milliliter | 0.93 |
| Total Base Number, mg KOH/gram | 80 |

By subsequent dilution with evaporative solvents, as well known and practiced in the lubricant art, the simple calcium sulfonate grease of Example 18 is suitable for use as a high performance open gear lubricant or braided wire rope lubricant. The total base number is about ten times that of a typical CJ-4 heavy duty engine oil. This property is very important in mining applications where ground water can be acidic with a pH value of as low as 2.5.

Although the examples provided herein fall primarily in the NLGI No. 2 or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. In like manner, as used herein the "dropping point" of a grease shall refer to the value obtained by using the standard dropping point test ASTM D2265 commonly used in lubricating grease manufacturing. As used herein, quantities of ingredients identified by percentages or parts are by weight of the final grease product, even though the particular ingredient (such as water) may not be present in the final grease or may not be present in the final grease in the quantity identified for addition as an ingredient. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

I claim:

1. A calcium sulfonate complex grease composition comprising the following ingredients:

around 10% to 36% overbased oil-soluble calcium sulfonate containing 28% to 36% dispersed calcium carbonate and 0% to 8% residual calcium oxide or calcium hydroxide;

2% to 20% crystalline calcium carbonate added in addition to the amount of dispersed calcium carbonate contained in the overbased oil-soluble calcium sulfonate;

wherein the calcium sulfonate complex grease has a worked 60 stroke penetration between 220 and 295 and a dropping point of 575 F or higher;

wherein the amount of dispersed calcium carbonate and residual calcium oxide or calcium hydroxide are by weight of the overbased oil-soluble calcium sulfonate and all other amounts are by weight of the final complex grease; and wherein no calcium oxide or calcium hydroxide is added in addition to the amount of residual calcium oxide or calcium hydroxide contained in the overbased oil-soluble calcium sulfonate.

2. The calcium sulfonate complex grease composition according to claim 1 further comprising:

2% to 10% water;

one or more other converting agents in a total amount of 0.5% to 5%; and one or more complexing acids in a total amount of 2.8% to 11%.

3. The calcium sulfonate complex grease composition according to claim 2 wherein the one or more other converting agents are selected from the group consisting of alcohols, ethers, glycols, glycol ethers, glycol polyethers, carboxylic acids, inorganic acids, organic nitrates, compounds that contain active hydrogen or compounds that contain tautomeric hydrogen; and wherein the one or more complexing acids are selected from the group consisting of a long chain carboxylic acid, a short chain carboxylic acid, boric acid, and phosphoric acid.

4. The calcium sulfonate complex grease composition according to claim 3 further comprising 0.5% to 5% dodecylbenzene sulfonic acid.

5. The calcium sulfonate complex grease composition of claim 1 wherein the amount of overbased oil-soluble calcium sulfonate is around 10% to 32%.

6. The calcium sulfonate complex grease composition of claim 1 wherein the amount of overbased calcium sulfonate is around 10% to 32%.

7. The calcium sulfonate complex grease composition of claim 3 further comprising 0.5% to 5% facilitating acid.

8. A calcium sulfonate complex grease composition comprising the following ingredients:

oil-soluble overbased calcium sulfonate having 28% to 36% dispersed calcium carbonate and 0% to 8% residual calcium oxide or calcium hydroxide dispersed therein, such amounts by weight of the oil-soluble overbased calcium sulfonate;

crystalline calcium carbonate added in addition to the amount of dispersed calcium carbonate contained in the oil-soluble overbased calcium sulfonate;

one or more converting agents;

one or more complexing acids;

wherein no calcium oxide or calcium hydroxide is added in addition to any amount of residual calcium oxide or calcium hydroxide contained in the oil-soluble overbased calcium sulfonate.

9. The calcium sulfonate complex grease composition according to claim 8 wherein the grease has a worked 60 stroke penetration between 265 and 295 and a dropping point of 575 F or higher.

10. The calcium sulfonate complex grease composition according to claim 9 comprising around 10% to 45% oil-soluble overbased calcium sulfonate.

11. The calcium sulfonate grease composition according to claim 8 wherein the crystalline calcium carbonate is added in a stoichiometrically excess amount relative to the total amount of complexing acids.

12. A simple calcium sulfonate grease composition comprising the following ingredients:

around 10% to 45% overbased calcium sulfonate containing calcium carbonate dispersed therein, wherein the dispersed calcium carbonate is in an amorphous state when the overbased calcium sulfonate is first added to the other ingredients and is converted to a crystalline state in the final simple grease product;

2% to 20% crystalline calcium carbonate added in addition to the amount of amorphous calcium carbonate contained in the overbased calcium sulfonate;

wherein the simple grease has a worked penetration between 240 and 475; and wherein the overbased calcium sulfonate contains 0% to 8% residual dispersed calcium oxide or calcium hydroxide and wherein no additional calcium oxide or calcium hydroxide is separately added.

13. The simple calcium sulfonate grease composition according to claim 12 further comprising:

0.5% to 5.0% C12 alkylbenzene sulfonic acid; and one or more converting agents selected from the group consisting of alcohols, ethers, glycols, glycol ethers, glycol polyethers, carboxylic acids, inorganic acids, organic nitrates, compounds that contain active hydrogen or compounds that contain tautomeric hydrogen, in a total amount of 0.1% to 5.0%.

14. A method for making an overbased calcium sulfonate complex grease comprising the steps of:

providing 10 to 45 parts overbased calcium sulfonate having 28% to 36% amorphous calcium carbonate and 0% to 8% residual calcium oxide or calcium hydroxide dispersed therein;

providing 2 to 20 parts of crystalline calcium carbonate as a separately added ingredient in addition to the amount of amorphous calcium carbonate contained in the overbased calcium sulfate;

mixing the overbased calcium sulfonate with 30 to 60 parts of a base oil, the separately added crystalline calcium carbonate, 2 to 10 parts water, and 0.5 to 5 total parts of one or more other converting agents to form a pre-conversion mixture;

converting the pre-conversion mixture to a converted mixture by heating until conversion of the amorphous calcium carbonate contained in the overbased calcium sulfonate to a crystalline form has occurred; and mixing 2.8 to 11 total parts of one or more complexing acids with the pre-conversion mixture, converted mixture, or both;

wherein no additional calcium oxide or calcium hydroxide is added in addition to any amount of residual calcium oxide or calcium hydroxide contained in the overbased calcium sulfonate and the separately added crystalline calcium carbonate is the sole calcium containing base added as a separate ingredient for reacting with the one or more complexing acids; and wherein the amount of amorphous calcium carbonate and residual calcium oxide or calcium hydroxide is by weight of the overbased calcium sulfonate and all other amounts are by weight of the final complex grease product.

15. The method according to claim 14 further comprising the steps of:

mixing 0.5 to 5 parts of a facilitating acid prior to addition of the one or more converting agents; and heating the mixture after addition of the one or more complexing acids to the converted mixture.

16. The method according to claim 14 wherein 15% to 45% of the total weight of a first complexing acid is added to the pre-conversion mixture prior to adding any converting agents with the other 85% to 55% of the total weight of such first complexing acid being added to the converted mixture.

17. The method according to claim 14 wherein the one or more complexing acids mixed with the pre-conversion mixture are different than the one or more complexing acids mixed with the converted mixture.

18. The method according to claim 14 wherein the pre-conversion mixture is mixed at ambient temperature for 5 to 20 minutes before applying heat.

19. The method according to claim 14 wherein 15% to 45% of the total weight of the one or more complexing acids is mixed with the pre-conversion mixture and 85% to 55% of the total weight of the one or more complexing acids is mixed with the converted mixture.

20. The calcium sulfonate grease product made by the process of claim 14.

21. The calcium sulfonate grease product made by the process of claim 16.

22. The calcium sulfonate grease product made by the process of claim 17.

23. The calcium sulfonate complex grease composition according to claim 2 wherein the separately added calcium carbonate is the only calcium containing base separately added for reaction with the one or more complexing acids.

24. The calcium sulfonate complex grease composition according to claim 2 wherein the dispersed calcium carbonate contained in the oil-soluble overbased calcium sulfonate is in an amorphous state when the overbased calcium sulfonate is first added to one or more of the other ingredients and is converted to a crystalline state in the final complex grease product.

25. The calcium sulfonate complex grease composition according to claim 1 wherein the crystalline calcium carbonate has a mean particle size between about 1 to 20 microns.

26. The calcium sulfonate complex grease composition according to claim 8 wherein the crystalline calcium carbonate has a mean particle size between about 1 to 20 microns.

27. The simple calcium sulfonate grease composition according to claim 12 wherein the crystalline calcium carbonate added in addition to the amount of amorphous calcium carbonate contained in the overbased calcium sulfonate has a mean particle size between about 1 to 20 microns.

28. The method according to claim 14 wherein the separately added crystalline calcium carbonate has a mean particle size between about 1to 20 microns.

* * * * *

UNITED STATES PATENT AND TRADEMARK OFFICE

CERTIFICATE OF CORRECTION

PATENT NO. : 9,273,265 B2
APPLICATION NO. : 13/664574
DATED : March 1, 2016
INVENTOR(S) : J. Andrew Waynick It is certified that error appears in the above-identified patent and that said Letters Patent is hereby corrected as shown below:

Claims

Column 20, ln. 15, “claim 1” should read --claim 2--, so that claim 6 depends from claim 2

Column 21, ln. 14, “calcium sulfate” in claim 14 should read --calcium sulfonate--

Signed and Sealed this
Third Day of May, 2016

Michelle K. Lee

Michelle K. Lee
*Director of the United States Patent and Trademark Office*